US006929482B2

(12) United States Patent
Benham

(10) Patent No.: US 6,929,482 B2
(45) Date of Patent: Aug. 16, 2005

(54) INTERCONNECTION ARRANGEMENT

(75) Inventor: John Benham, Torrington, CT (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/760,414

(22) Filed: Jan. 21, 2004

(65) Prior Publication Data

US 2004/0152359 A1 Aug. 5, 2004

Related U.S. Application Data

(60) Provisional application No. 60/442,540, filed on Jan. 27, 2003.

(51) Int. Cl.[7] ..... H01R 12/00
(52) U.S. Cl. ..... 439/63; 439/638; 439/912
(58) Field of Search ..... 439/63, 578, 579, 439/581, 582, 638, 912

(56) References Cited

U.S. PATENT DOCUMENTS 5,823,795 A * 10/1998 Schumacher ..... 439/76.1
6,280,201 B1 * 8/2001 Morris ..... 439/65
6,575,762 B2 * 6/2003 Evans ..... 439/63
6,682,354 B2 * 1/2004 Carson et al. ..... 439/63
6,808,395 B2 * 10/2004 Lin et al. ..... 439/63

* cited by examiner

*Primary Examiner*—Khiem Nguyen
(74) *Attorney, Agent, or Firm*—Rothwell, Figg, Ernst & Manbeck

(57) ABSTRACT

An electrical interconnection arrangement includes a cable laminate adapted to receive a plurality of twinaxial cables; an interposer including a plurality of spring contacts; wherein the interposer has a first side adapted to mate with the cable laminate and electrically connect the plurality of spring contacts to one and of the plurality of twinaxial cables; and wherein the interposer has a second side adapted to mate with a PC board and electrically connect the plurality of spring contacts to mating contact points on the PC board. The arrangement may also include an adapter adapted to receive a twinaxial cable; and first and second coaxial cable type connectors located on the adapter; wherein an inner conductor of the first coaxial cable type connector is electrically connected to a first inner conductor of the twinaxial cable and an inner conductor of the second coaxial cable type connector is electrically connected to a second inner conductor of the twinaxial cable; and wherein an outer shell of the first and second coaxial cable type connectors is connected to an outer conductive shield of the twinaxial cable.

19 Claims, 8 Drawing Sheets

INTERCONNECTION ARRANGEMENT

RELATED APPLICATION

The present application claims the benefit of U.S. Provisional Application Ser. No. 60/442,540 filed Jan. 27, 2003.

BACKGROUND OF THE INVENTION

1. Field of the Invention

The present invention relates to an electrical interconnection arrangement and more particularly, the present invention relates to an interconnection arrangement that enables interfacing between twinaxial connections and coaxial connections.

2. Description of the Related Art

Backplane systems are comprised of a complex printed circuit board that is referred to as the backplane or motherboard, and several smaller printed circuit boards that are referred to as daughtercards, which plug into the backplane. Each of the daughtercards may include a chip that is referred to as a driver/receiver. The driver/receiver sends and receives signals from driver/receivers on other daughtercards. A signal path is formed between the driver/receiver on a first daughtercard and a driver/receiver on a second daughtercard. The signal path includes an electrical connector that connects the first daughtercard to the backplane, a second electrical connector that connects the second daughtercard to the backplane, with the second daughtercard having the driver/receiver that receives the carried signal. Various driver/receivers being used today can transmit signals at data rates between 5–10 Gb/sec and greater. The limiting factor (data transfer rate) in the signal path are the electrical connectors that connect each daughtercard to the backplane. A need thus existed in the art for a high-speed electrical connector capable of handling the required high-speed transfer of data.

The need for a high-speed electrical connector capable of handling the required high-speed transfer of data has been met by the connector disclosed in copending U.S. application Ser. No. 10/234,859, filed in the U.S. Patent and Trademark Office on Sep. 5, 2002, entitled "Interconnection System", and bearing a common Assignee to that of the present application, the disclosure of which is hereby incorporated by reference in its entirety into the present application. This connector 2200, as illustrated in FIG. 1, in conjunction with interposers 2300 as illustrated in FIG. 2, allows multiple high-speed interconnections between two circuit boards utilizing multiple twinaxial connections. As illustrated in FIG. 2, the connector of FIG. 1 interfaces with the PC board 2600 via the interposers 2300. The interposers 2300 utilize a plurality of spring contacts to electrically connect the twinaxial cable ends of the connector to mating contact points on the PC board 2600.

It was found, however, that a need arose for an interconnection arrangement to electrically test the PC board 2600 via the mating contact points. It was also found that a need arose for adapting the twinaxial cable so as to electrically test it using commercially available test equipment having only coaxial cable connectors. Still furthermore, a need arose for an interconnection arrangement to electrically connect spaced apart PC boards so as to enable high-speed data transfer therebetween utilizing semirigid or flexible cables.

SUMMARY OF THE INVENTION

An object of the present invention to substantially satisfy the above-mentioned needs.

It is an object of the present invention to provide an electrical interconnection arrangement capable of carrying signals at data rates between 5–10 Gb/sec or more.

Still another object of the present invention is to provide an electrical interconnection arrangement having a plurality of differential pairs each of having constant impedance over the signal path and capable of carrying signals at between 5–10 Gb/sec or more.

Another object of the present invention is to provide an electrical interconnection arrangement in which cross-talk between signal paths of adjacent cables is reduced and/or eliminated.

Yet another object of the present invention is to provide a compression type electrical interconnection arrangement using a conductive spring configuration to interface the electrical connector with its mating PC board.

Another object of the present invention is to provide an adapter to enable a twinaxial cable to be electrically connected to two coaxial cable type connectors.

These and other objects of the present invention are achieved by providing an electrical interconnection arrangement comprising: a cable laminate adapted to receive a plurality of twinaxial cables; an interposer including a plurality of spring contacts and having a first side adapted to mate with the cable laminate and electrically connect the plurality of spring contacts to the plurality of twinaxial cables and having a second side adapted to mate with a PC board and electrically connect the plurality of spring contacts to mating contact points on the PC board, thereby electrically connecting the twinaxial cables to the PC board.

The above noted arrangement may further comprise a plurality of adapters, each of the adapters adapted to receive a respective one of the plurality of twinaxial cables; and first and second coaxial cable type connectors located on each of the adapter; wherein an inner conductor of the first coaxial cable type connector of the each of the plurality of adapters is electrically connected to a first inner conductor of its respective twinaxial cable and an inner conductor of the second coaxial cable type connector of each of the plurality of adapters is electrically connected to a second inner conductor of its twinaxial cable; and wherein an outer shell of the first and second coaxial cable type connectors of each of the adapters is connected to an outer conductive shield of its respective twinaxial cable, thereby enabling each of the plurality of twinaxial cables to be electrically connected to two respective coaxial cable type connectors.

The above noted arrangement may also further comprise another cable laminate adapted to receive a second end of the plurality of twinaxial cables; another interposer including a another plurality of spring contacts; wherein the another interposer has a first side adapted to mate with the another cable laminate and electrically connect the plurality of spring contacts to the another end of the plurality of twinaxial cables; and wherein the another interposer has a second side adapted to mate with another PC board and electrically connect the another plurality of spring contacts to mating contact points on the another PC board, thereby electrically connecting the another PC board to the PC board.

These and other objects of the present invention may also be achieved by providing an electrical interconnection arrangement comprising an adapter adapted to receive a twinaxial cable and first and second coaxial cable type connectors, an inner conductor of the first coaxial cable type connector being electrically connected to a first inner conductor of the twinaxial cable and an inner conductor of the second coaxial cable type connector being electrically connected to a second inner conductor of the twinaxial cable and an outer shell of the first and second coaxial cable type connectors being connected to an outer conductive shield of the twinaxial cable, thereby enabling the twinaxial cable to be electrically connected to two coaxial cable type connectors.

The above noted arrangement may further comprise another adapter adapted to receive the twinaxial cable; and third and fourth coaxial cable type connectors located on the another adapter; wherein an inner conductor of the third coaxial cable type connector is electrically connected to a first inner conductor of the twinaxial cable and an inner conductor of the fourth coaxial cable type connector is electrically connected to a second inner conductor of the twinaxial cable; and wherein an outer shell of the third and fourth coaxial cable type connectors is connected to an outer conductive shield of the twinaxial cable, thereby enabling the third and fourth coaxial cable type connectors to be respectively electrically connected to two coaxial cable type connectors.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto. This spirit and scope of the present invention are limited only by the terms of the appended claims.

DETAILED DESCRIPTION OF THE INVENTION

Figure 1:
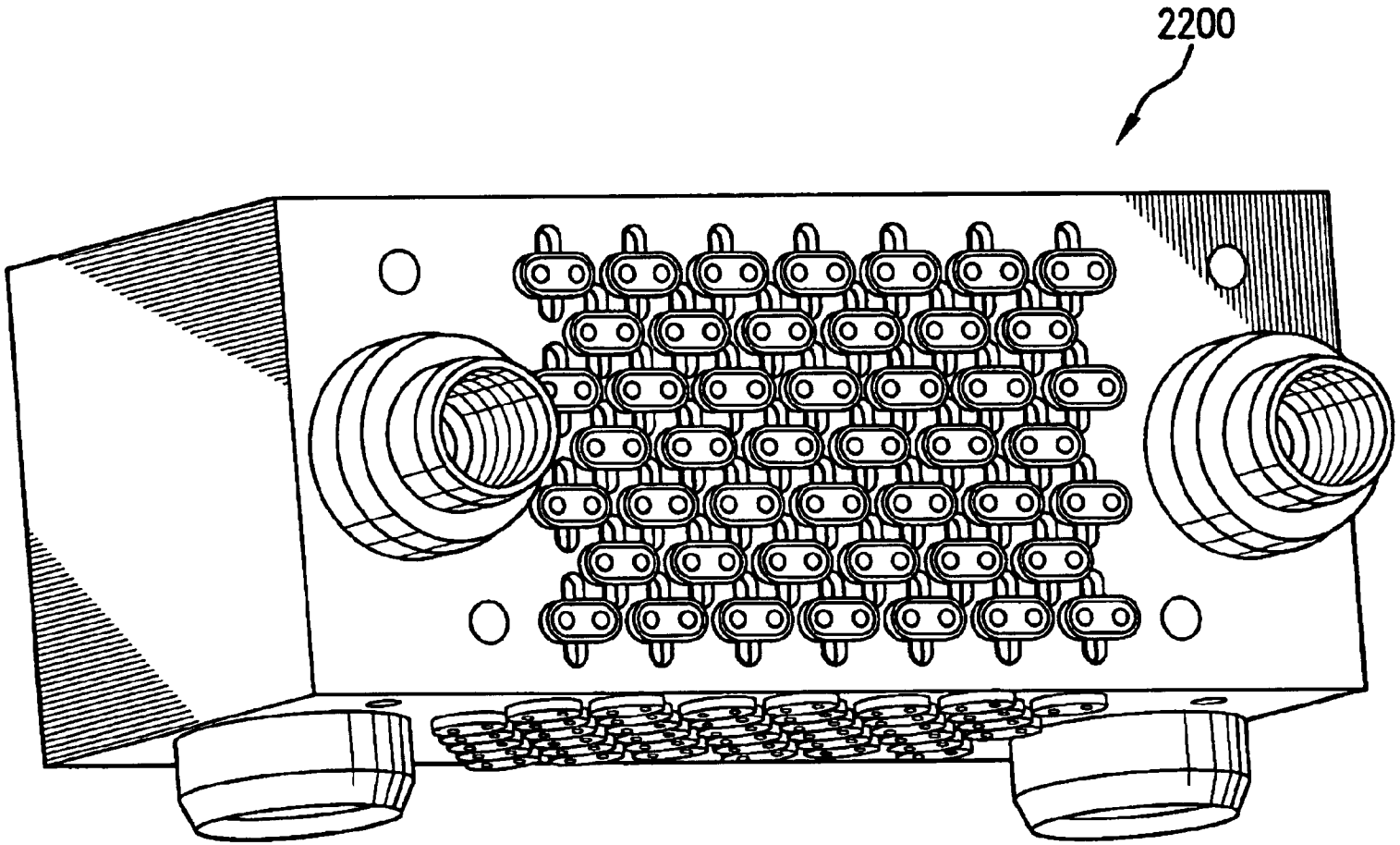
FIGS. 1 and 2 are illustrations of a connector in accordance with the interconnection system of the aforecited copending patent application.
Figure 2:
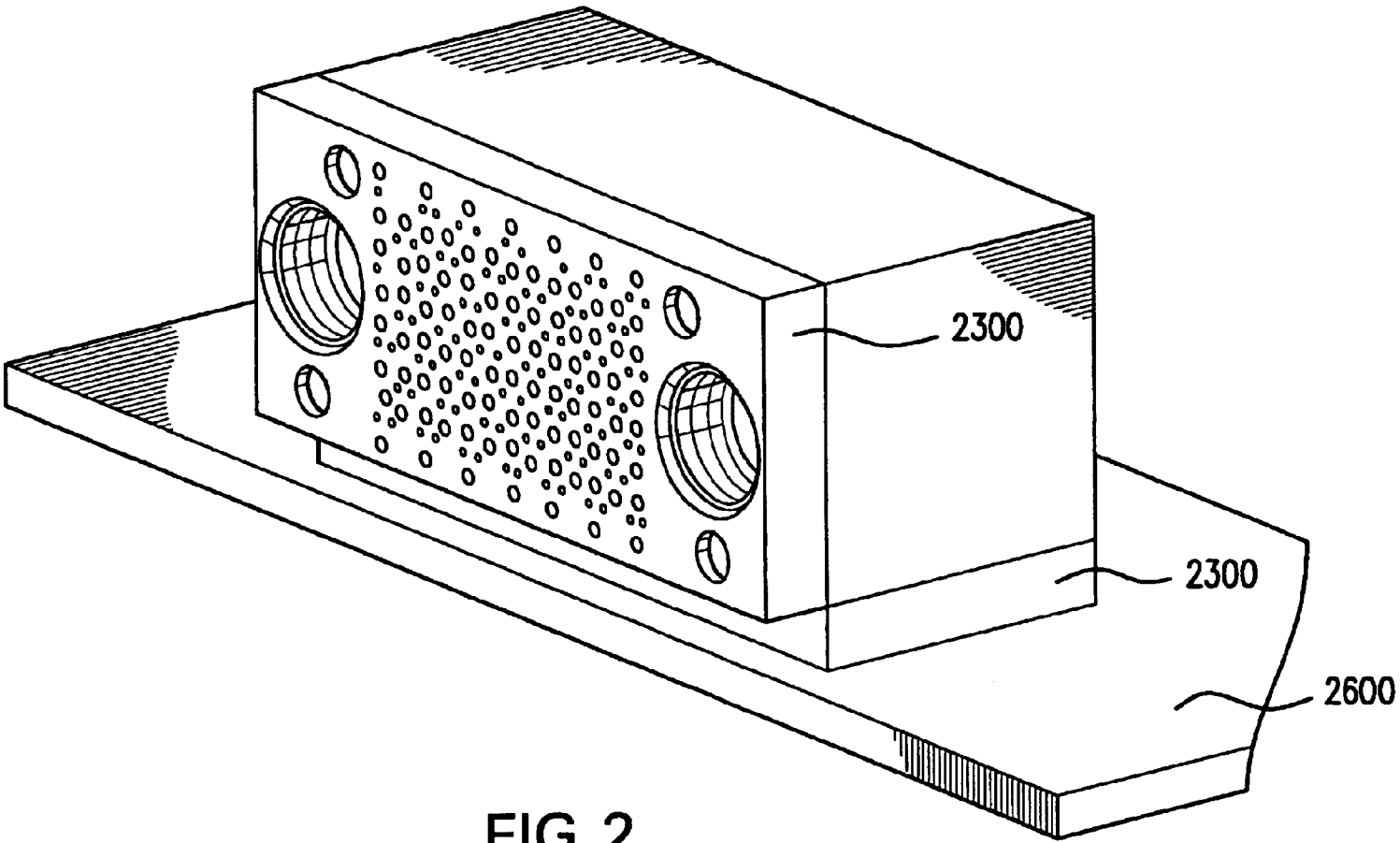
Figure 3:
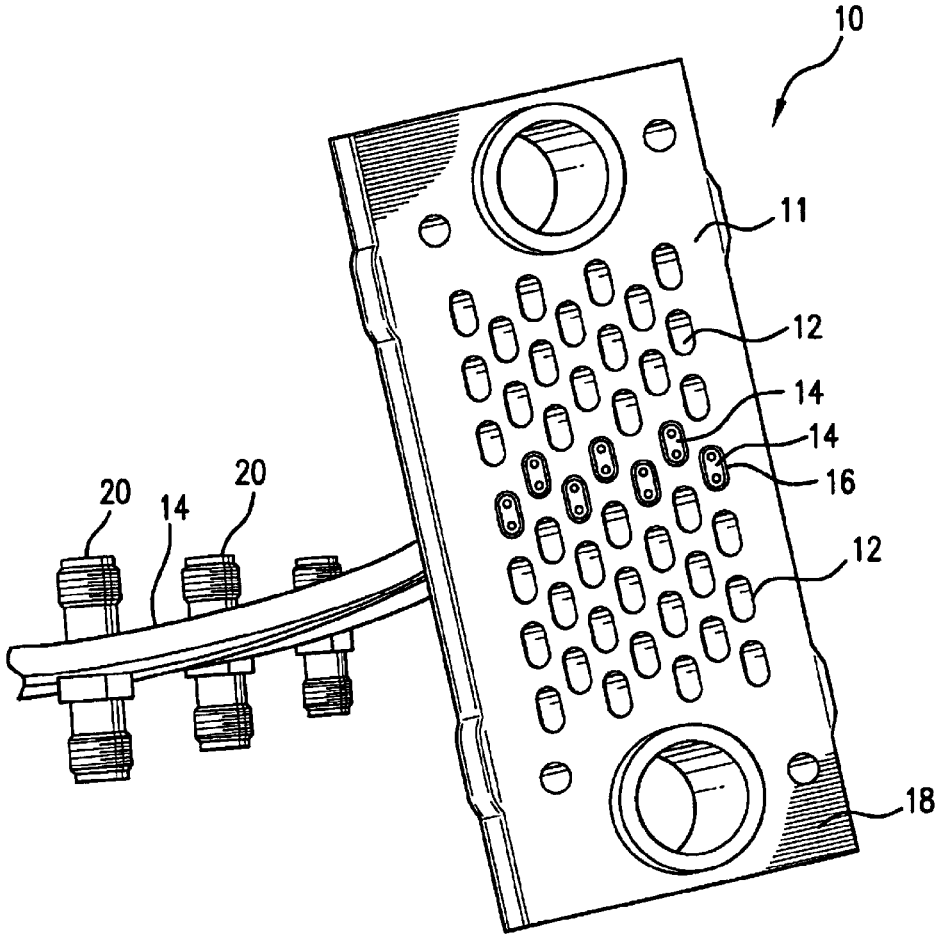
FIG. 3 is an illustration of a cable laminate portion of a connector arrangement in accordance with an embodiment of the present invention.

FIG. 3 illustrates a cable laminate portion 10 of a connector arrangement in accordance with the principles of the present invention. The cable laminate portion 10 includes a laminate plate 11 formed of an electrically non-conductive material. The cable laminate plate 11 includes a plurality of apertures 12 adapted to receive a respective plurality of twinaxial cables 14. Ends 16 of the twinaxial cables 14 (preferably semi-rigid 100-Ohm) are preferably in the same plane and may either be flush with one surface 18, the cable laminate portion 10 or raised therefrom, depending on the construction of the mating interposer to be discussed below. An adapter 20 is connected to an opposite end of the twinaxial cable 14 for each cable 14.

Figure 4:
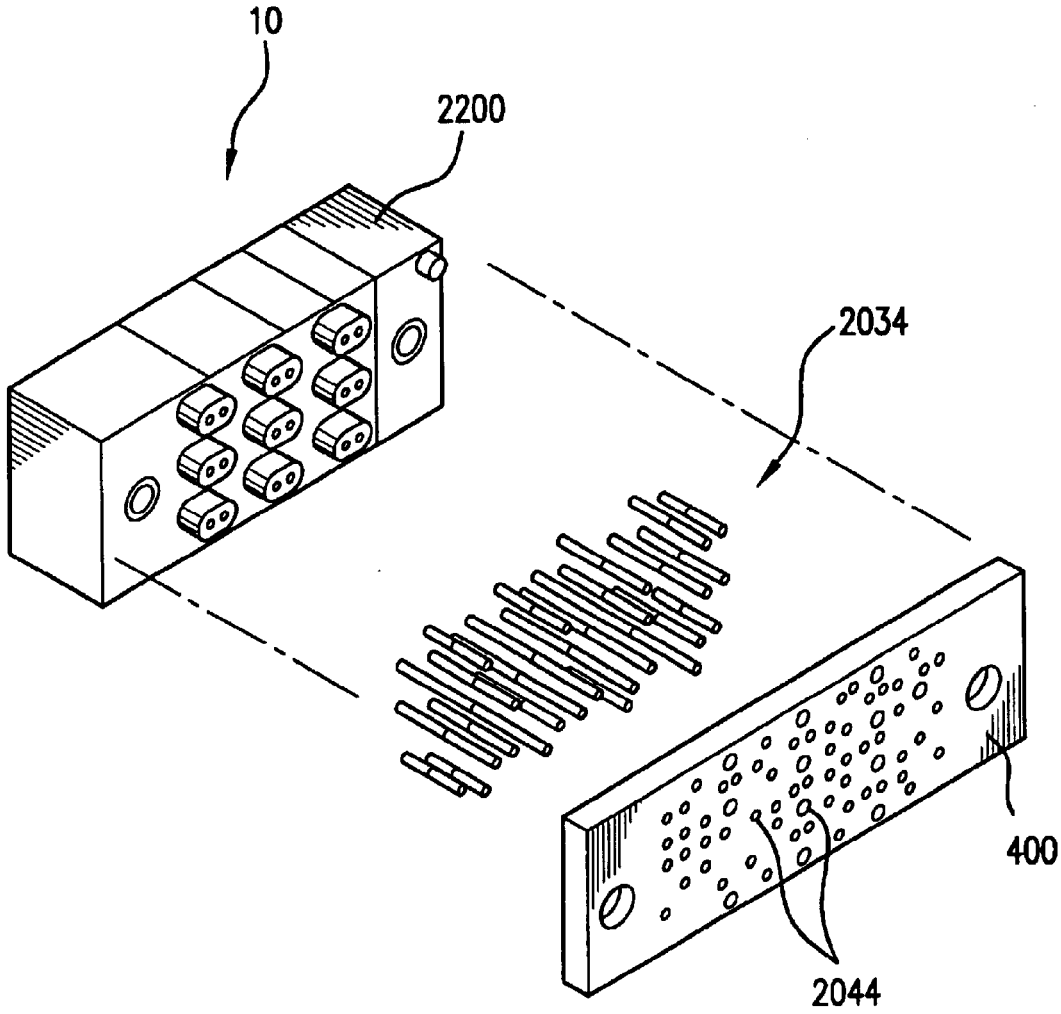
FIG. 4 is an illustration of an example of an interposer adapted to mate with the cable laminate portion of FIG. 3.

FIG. 4 illustrates an example of an interposer 400 adapted to mate with the cable laminate portion 10 of FIG. 3. As illustrated therein, a plurality of apertures 2044 are formed within the interposer 400, the apertures adapted to receive a plurality of spring contacts 2034. One side of the interposer is adapted to mate with the cable laminate portion 10 of FIG. 3. The spring contacts 2034 contact the inner conductors and outer shields of the exposed twinaxial cable ends of the interposer 2200 as explained in greater detail in U.S. application Ser. No. 10/036,796 filed Jan. 7, 2002, the disclosure of which is hereby incorporated by reference in its entirety. For example, each twinaxial cable end 16 has a corresponding spring contact 2034 on the interposer 400 to respectively electrically connect the inner conductors thereto and has four corresponding spring contacts 2034 on the interposer 400 to electrically connect the outer shield of each twinaxial cable end thereto.

Figure 5:
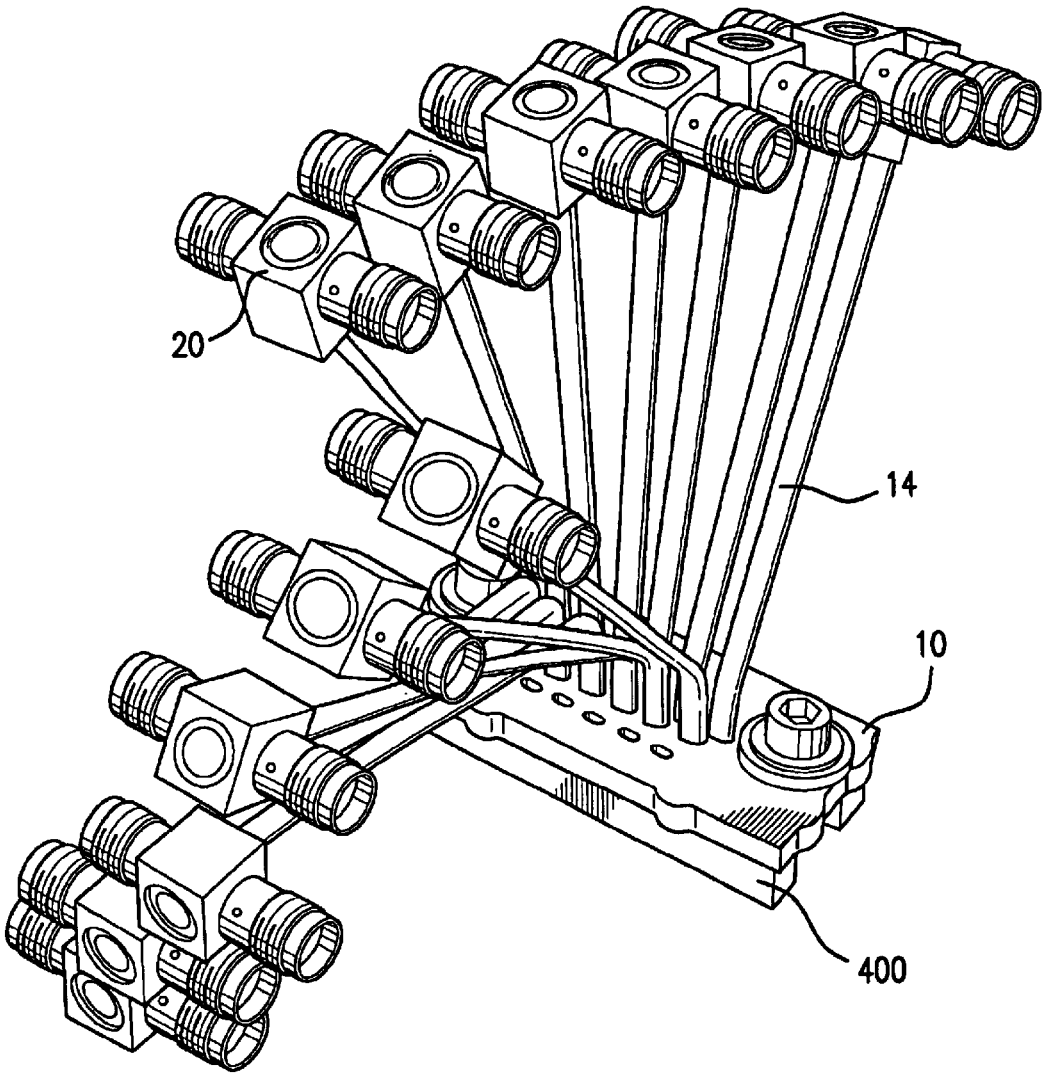
FIG. 5 is an illustration of the interposer mated with the cable laminate portion, including hardware.

FIG. 5 illustrates the interposer 400 mated with the cable laminate portion 10, including hardware to secure the combination together and to allow the combination to be mated with a corresponding PC board. Note that if the interconnection arrangement is to be used to test the electrical characteristics of the PC board to which it is being mated, the arrangement of the combination including hardware must correspond to that of the connector that normally mates with the PC board. In fact, the interposer 400 of FIG. 4 can be similar to or identical to the interposer disclosed in the aforecited copending patent application.

Figure 6:
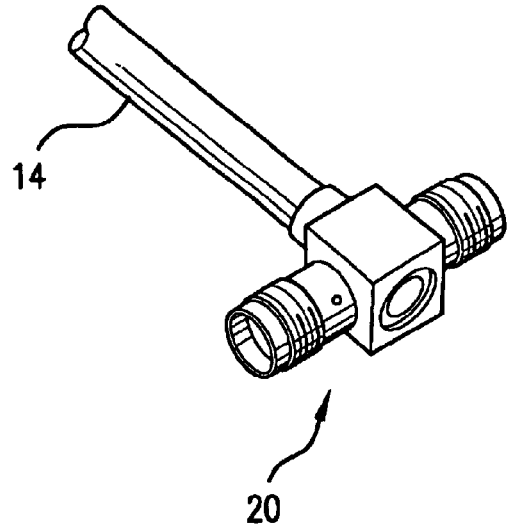
FIG. 6 is an illustration of an adapter in accordance with an embodiment of the interconnection arrangement of the present invention.
Figure 7A:
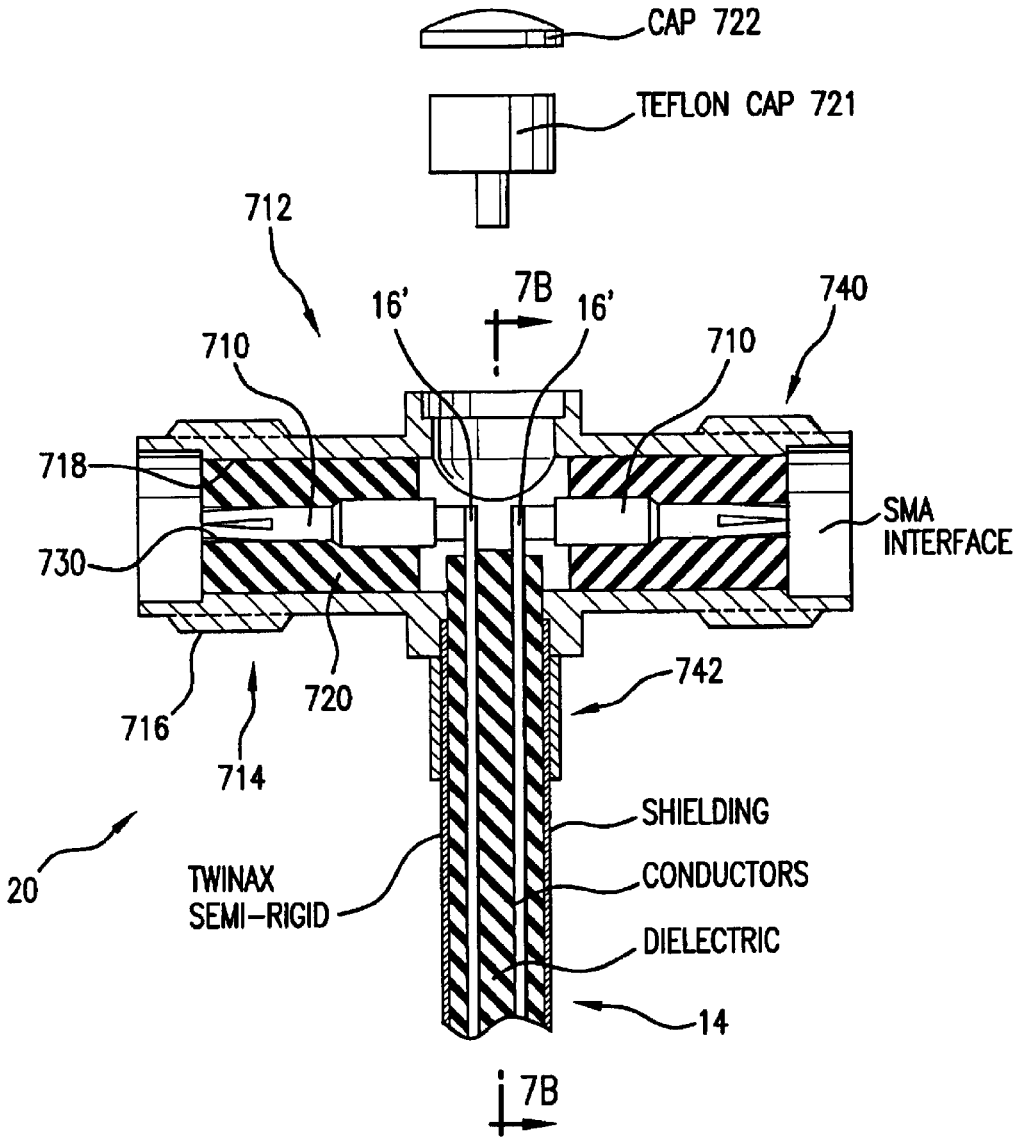
FIG. 7A is a cross-sectional view of the adapter of FIG. 6.
Figure 7B:
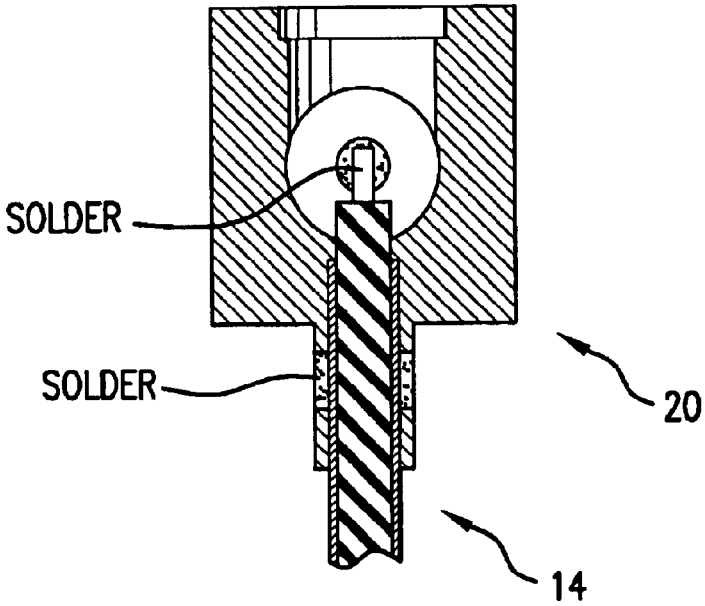
FIG. 7B is a cross-sectional view of the adapter of FIG. 7A taken along line 7A–7B.
Figure 7C:
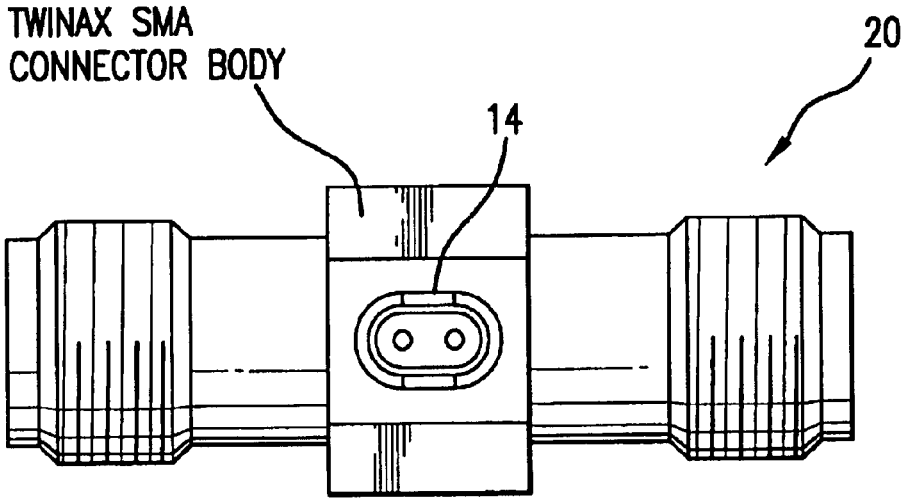
FIG. 7C is a bottom view of the adapter of FIG. 7A.

FIG. 6 illustrates the adapter 20 in accordance with an embodiment of the interconnection arrangement of the present invention. FIG. 7A is a cross-sectional view of the adapter of FIG. 6. The adapter 20 has a one piece body 712 having a T-shape, although other shapes can be used. One connection 714 has external threads 716 and a cylindrical bore 718 into which a cylindrical electrical insulator 720 is positioned. The electrical insulator 720 has a central thru bore 730 into which a coaxial connector 710 is positioned. The opposite connection 740 of the T-shaped body 712 has the same configuration as the opposite parallel connection 714. Each connection 714, 740 provides an SMA interface, although other RF interfaces are usable, such as an MCX interface, 2.4 mm or similar. As illustrated in FIG. 7A, the twinaxial cable 16 has its inner conductors 16' respectively electrically connected to the inner conductors 710 of the two coaxial type connectors of the adapter. The body 712 has a leg 742 which is electrically connected to the outer shield of the twinaxial cable. Although a one-piece adapter is shown and is preferable for mass production of the adapter, other adapter, such as a two-piece soldered together can be used. A Teflon™ cap 721 and a cap 722 are located opposite the twinax cable 14 in order to seal the adapter 20.

Returning to FIG. 5, adapters 20 are illustrated as being connected to respective ends of the twinaxial cables 14 with the other ends thereof being connected to the interposer/cable laminate portion/hardware combination. This arrangement allows the PC board to be electrically connected to coaxial type connectors, thereby facilitating testing of the PC board or to facilitate connection of the PC board to other electrical elements having only coaxial connectors without adding line discontinuities resulting in inaccurate testing of the PC board or degraded connections between the other electrical elements and the PC board.

Figure 8:
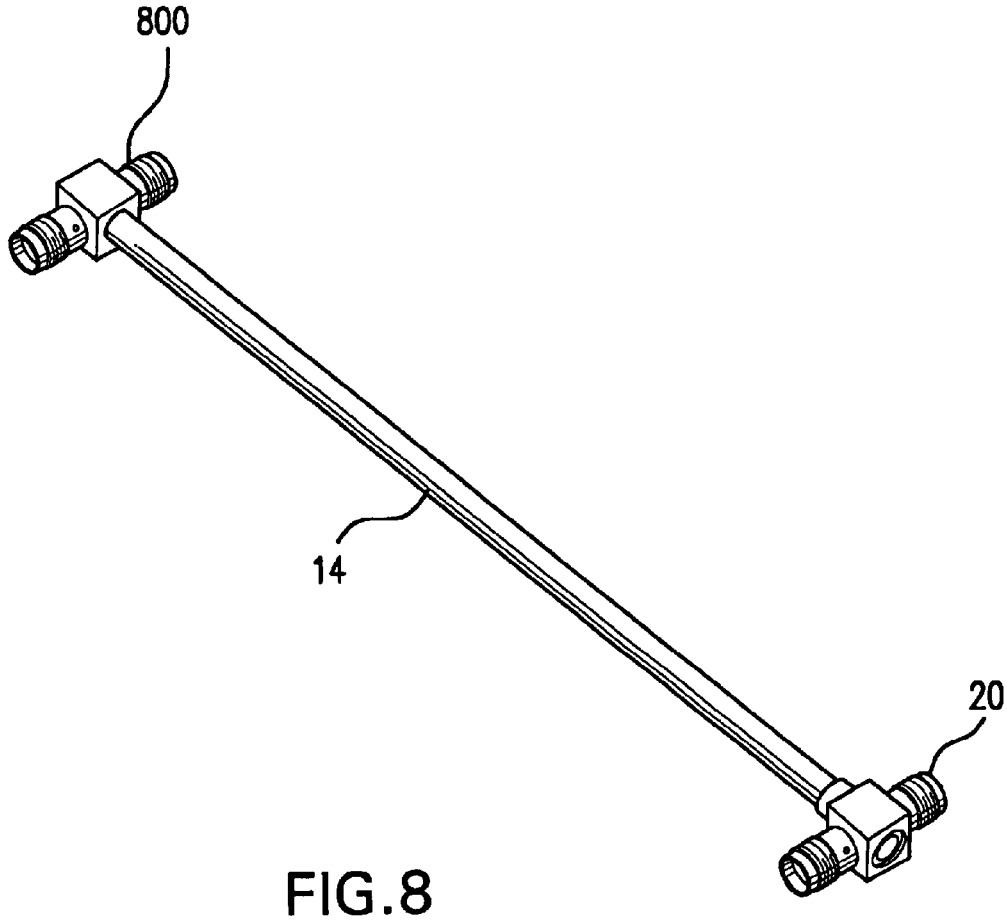
FIG. 8 is an illustration of adapters positioned on both ends of a twinaxial cable.

FIG. 8 illustrates adapters 20 placed on both ends of a twinaxial cable. This allows the interconnection of two electrical elements having only coaxial connectors with the inherent advantages of twinaxial cables.

While not illustrated, it is apparent to one skilled in the art that interposer/cable laminate portion/hardware combinations can be respectively connected to both ends of a twinaxial cable. This allows for the interconnection of two PC boards that are spaced apart and cannot be connected together with the connector of the interconnection system of the aforecited copending patent application. Advantageously, the present invention minimizes reflection and insertion losses for the RF connector according to the present invention.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangements within the scope of the foregoing disclosure, the drawings, and the appended claims without departing from the spirit of the invention. In additions to variations and modifications in the component parts and/or arrangements, alternative uses will also be apparent to those skilled in the art.

What is claimed is:

1. An electrical interconnection arrangement for mating to a PC board, comprising:

a cable laminate adapted to receive a plurality of twinaxial cables;

an interposer including a plurality of spring contacts;

wherein said interposer has a first side adapted to mate with said cable laminate and electrically connect said plurality of spring contacts each to one end of said plurality of twinaxial cables; and wherein said interposer has a second side adapted to mate with the PC board and electrically connect said plurality of spring contacts to mating contact points on the PC board, thereby electrically connecting said twinaxial cables to the PC board.

2. An electrical interconnection arrangement comprising:

an adapter adapted to receive a twinaxial cable; and first and second coaxial cable type connectors located on said adapter;

wherein an inner conductor of said first coaxial cable type connector is electrically connected to a first inner conductor of said twinaxial cable and an inner conductor of said second coaxial cable type connector is electrically connected to a second inner conductor of said twinaxial cable; and wherein an outer shell of said first and second coaxial cable type connectors is connected to an outer conductive shield of said twinaxial cable, thereby enabling said twinaxial cable to be electrically connected to two coaxial cable type connectors.

3. The arrangement of claim 1, further comprising:

a plurality of adapters, each of said adapters adapted to receive a respective one of said plurality of twinaxial cables; and first and second coaxial cable type connectors located on each of said adapter;

wherein an inner conductor of said first coaxial cable type connector of the each of said plurality of adapters is electrically connected to a first inner conductor of its respective twinaxial cable and an inner conductor of said second coaxial cable type connector of each of said plurality of adapters is electrically connected to a second inner conductor of its twinaxial cable; and wherein an outer shell of said first and second coaxial cable type connectors of each of said adapters is connected to an outer conductive shield of its respective twinaxial cable, thereby enabling each of said plurality of twinaxial cables to be electrically connected to two respective coaxial cable type connectors.

4. The arrangement of claim 1, further comprising:

another cable laminate adapted to receive a second end of said plurality of twinaxial cables;

another interposer including a another plurality of spring contacts;

wherein said another interposer has a first side adapted to mate with said another cable laminate and electrically connect said plurality of spring contacts to said another end of said plurality of twinaxial cables; and wherein said another interposer has a second side adapted to mate with another PC board and electrically connect said another plurality of spring contacts to mating contact points on said another PC board, thereby electrically connecting said another PC board to said PC board.

5. The arrangement of claim 2, further comprising:

another adapter adapted to receive said twinaxial cable; and third and fourth coaxial cable type connectors located on said another adapter;

wherein an inner conductor of said third coaxial cable type connector is electrically connected to a first inner conductor of said twinaxial cable and an inner conductor of said fourth coaxial cable type connector is electrically connected to a second inner conductor of said twinaxial cable; and wherein an outer shell of said third and fourth coaxial cable type connectors is connected to an outer conductive shield of said twinaxial cable, thereby enabling said third and fourth coaxial cable type connectors to be respectively electrically connected to two coaxial cable type connectors.

6. The arrangement of claim 1, wherein said cable laminate is made of an electrically non-conductive material and said interposer is made of an electrically non-conductive material.

7. The arrangement of claim 1, wherein said spring contacts are fuzz buttons.

8. The arrangement of claim 1, wherein impedance is +/−5%.

9. An electrical interconnection arrangement, comprising:

a plurality of adapters, each of said adapters adapted to receive one of a plurality of twinaxial cables; and first and second coaxial cable type connectors located on each of said adapter;

wherein an inner conductor of said first coaxial cable type connector of the each of said plurality of adapters is electrically connected to a first inner conductor of its respective twinaxial cable and an inner conductor of said second coaxial cable type connector of each of said plurality of adapters is electrically connected to a second inner conductor of its twinaxial cable; and wherein an outer shell of said first and second coaxial cable type connectors of each of said adapters is connected to an outer conductive shield of its respective twinaxial cable, thereby enabling each of said plurality of twinaxial cables to be electrically connected to two respective coaxial cable type connectors.

10. The electrical interconnection of claim 9 further comprises:

a cable laminate adapted to receive a respective one of said plurality of twinaxial cables;

an interposer including a plurality of spring contacts;

wherein said interposer has a first side adapted to mate with said cable laminate and electrically connect said plurality of spring contacts each to one end of said plurality of twinaxial cables; and wherein said interposer has a second side adapted to mate with the PC board and electrically connect said plurality of spring contacts to mating contact points on the PC board, thereby electrically connecting said twinaxial cables to the PC board.

11. The arrangement of claim 9, further comprising:

another cable laminate adapted to receive a second end of said plurality of twinaxial cables;

another interposer including a another plurality of spring contacts;

wherein said another interposer has a first side adapted to mate with said another cable laminate and electrically connect said plurality of spring contacts to said another end of said plurality of twinaxial cables; and wherein said another interposer has a second side adapted to mate with another PC board and electrically connect said another plurality of spring contacts to mating contact points on said another PC board, thereby electrically connecting said another PC board to said PC board.

12. The arrangement of claim 2, wherein said adapter has a T-shape.

13. The arrangement of claim 3, wherein an electrically non-conductor insulator is positioned in one connection of said adapter and a coaxial cable is positioned therein and one end thereof is in contact with a twinax cable.

14. The arrangement of claim 3, wherein said adapter has a T-shape.

15. The arrangement of claim 3, wherein an electrically non-conductor insulator is positioned in one connection of said adapter and a coaxial cable is positioned therein and one end thereof is in contact with a twinax cable.

16. The arrangement of claim 5, wherein said adapter has a T-shape.

17. The arrangement of claim 5, wherein an electrically non-conductor insulator is positioned in one connection of said adapter and a coaxial cable is positioned therein and one end thereof is in contact with a twinax cable.

18. The arrangement of claim 9, wherein said adapter has a T-shape.

19. The arrangement of claim 9, wherein an electrically non-conductor insulator is positioned in one connection of said adapter and a coaxial cable is positioned therein and one end thereof is in contact with a twinax cable.

* * * * *